United States Patent [19]

Jenkins

[11] 4,359,250

[45] Nov. 16, 1982

[54] DISHWASHER TUB AND FRAME ASSEMBLY

[75] Inventor: Thomas E. Jenkins, Louisville, Ky.

[73] Assignee: General Electric Company, Louisville, Ky.

[21] Appl. No.: 203,731

[22] Filed: Nov. 3, 1980

[51] Int. Cl.[3] ..... A47B 77/06

[52] U.S. Cl. ..... 312/228; 312/229; 312/253

[58] Field of Search ..... 312/228, 229, 311, 253, 312/348; 248/677, 188.8

[56] References Cited

U.S. PATENT DOCUMENTS

| | | | |
|---|---|---|---|
| 1,425,072 | 8/1922 | Adams | 248/188.8 |
| 2,247,178 | 6/1941 | Schultz | 312/253 |
| 2,535,528 | 12/1950 | Brodbeck | 312/253 |
| 3,032,382 | 5/1962 | Jordan | 312/253 |
| 3,044,842 | 7/1962 | Abresch et al. | 312/348 |
| 3,811,746 | 5/1974 | Butsch et al. | 312/228 |
| 3,826,455 | 7/1974 | O'Donnell | 248/188.8 |
| 3,826,553 | 7/1974 | Cushing et al. | 312/253 |

FOREIGN PATENT DOCUMENTS

| | | | |
|---|---|---|---|
| 1342261 | 9/1962 | France | 312/253 |

*Primary Examiner*—Victor N. Sakran

*Attorney, Agent, or Firm*—H. Neil Houser; Radford M. Reams

[57] ABSTRACT

A dishwasher tube and frame assembly incorporating an integrally molded plastic tub is provided which employs a very narrow metal collar or main support frame formed from a continuous metal member of U-shaped cross section configured as an inverted U having a base and legs extending downwardly for mounting on the supporting surface or floor; a rigid front cross member; and a pair of rear support members. The main frame surrounds the top and sides of the tub adjacent the front opening of the tub. The rigid front cross member is secured to the legs and extends beneath the front opening of the tub providing vertical support for the tub and enhancing the lateral rigidity of the main support frame.

Rear support is provided by the rear support members, each of which extends rearwardly from respective ends of the main support frame legs generally parallel to the supporting surface, and terminates in an upwardly extending portion which supportingly engages the tub bottom. A rear cross member extends between the upwardly extending portions beneath the tub bottom to provide vertical support to the tub bottom.

5 Claims, 3 Drawing Figures

DISHWASHER TUB AND FRAME ASSEMBLY

BACKGROUND OF THE INVENTION

The present invention relates generally to tub and frame assemblies for front loading appliances. More specifically, the invention relates to front loading dishwashers incorporating molded plastic tubs.

Front loading dishwashers incorporating molded plastic tubs are presently commercially available. Exemplary dishwashers of this type are illustrated and described in commonly-assigned U.S. Pat. Nos. 3,826,553 and 3,811,746.

The advantages of using a one-piece plastic dishwasher tub rather than a metal tub are numerous. For example, cost factors are greatly decreased in the manufacture of a molded plastic tub as compared to those involved in the manufacture of a metal tub, which requires an inner coating or lining operation. Other advantages include a reduction in finishing labor requirements, particularly tub welding operations, a longer tub life due to corrosion resistance which is independent of faulty coating procedures or chipping, and a decrease in thermal and acoustical transmission which minimizes the need for separate heat and sound insulation.

However, plastic tubs tend to deform. Deformation may occur when the tub is subjected to the high normal operating temperatures in a dishwasher, such as to approximately 180° F. Deformation may also occur when the tub is subjected to various loading forces, such as the weight of the dishwasher itself when placed on an uneven flow. Such deformation is undesirable and should be prevented for several reasons. It is particularly important that the original cross sectional rectangular shape of the tub be maintained in order for the swing-down door on a front-loading dishwasher to maintain a proper water seal to prevent leakage. Additionally, dish racks are usually mounted to slide in and out of the dishwasher, an action which would be inhibited by tub deformation. Further, if a tub deforms under heat or load forces its appearance or "feel" of quality is reduced.

To combat deformation problems, the dishwashers described in the aforementioned patents employ a relatively substantial box-like metallic base and a relatively substantial metallic collar placed around the tub. While this arrangement satisfactorily controls tub deformation and provides significant material and labor cost savings over metallic tub arrangements, the collar and base are relatively structurally complex, employ a significant amount of steel, and require significant labor time in assembly.

It is desirable to provide a tub assembly for a plastic tub which retains the structural rigidity provided by a steel frame, but which employs significantly less steel than prior art arrangements and which is less complex to assemble.

Therefore, it is an object of the present invention to provide a tub assembly incorporating a plastic tub for a front loading washing appliance which retains the structural advantages of the steel frame while employing substantially less steel, thereby reducing material costs, and which involves a greatly simplified configuration, facilitating assembly and reducing labor costs.

SUMMARY OF THE INVENTION

It has been found that the requisite structural integrity for a dishwasher tub and frame assembly incorporating a plastic tub can be achieved employing a very narrow metal collar or main support frame formed from a continuous metal member of U-shaped cross section configured as an inverted U having a base and legs extending downwardly for mounting the supporting surface or floor; a rigid front crossing member; and a pair of rear support members. The main frame surrounds the top and sides of the tub adjacent the front opening of the tub. The rigid front cross member is secured to the legs and extends beneath the front opening of the tub providing vertical support for the tub and enhancing the lateral rigidity of the main support frame.

Rear support is provided by the rear support members, each of which extends rearwardly from respective ends of the main support frame legs generally parallel to the supporting surface, and terminates in an upwardly extending portion which supportingly engages the tub bottom. A rear cross member extends between the upwardly extending portions beneath the tub bottom to provide vertical support to the tub bottom.

A rigid metallic bottom liner is secured to and extends beneath the tub bottom. The liner provides rigidity to the tub bottom; provides a mechanical mount for the dishwasher pump and motor assembly; accurately locates and supports the dishwasher spray arm; and provides a flame barrier between the tub bottom and electrically powered dishwasher components.

DETAILED DESCRIPTION

Figure 1:
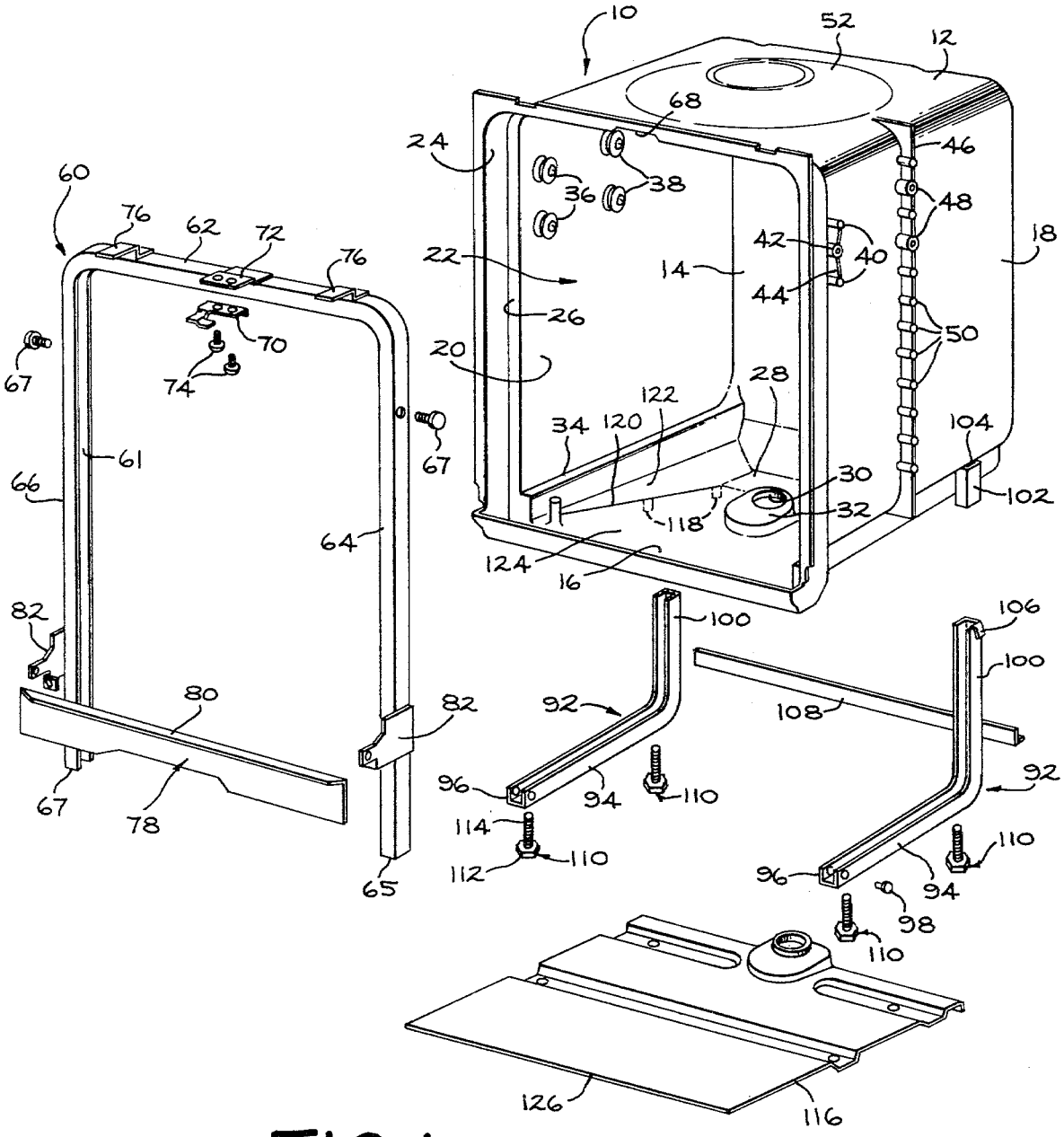
FIG. 1 is an exploded perspective view of a dishwasher tub assembly illustratively embodying the present invention, the view being somewhat simplified in form and with some parts omitted for the sake of simplicity.
Figure 2:
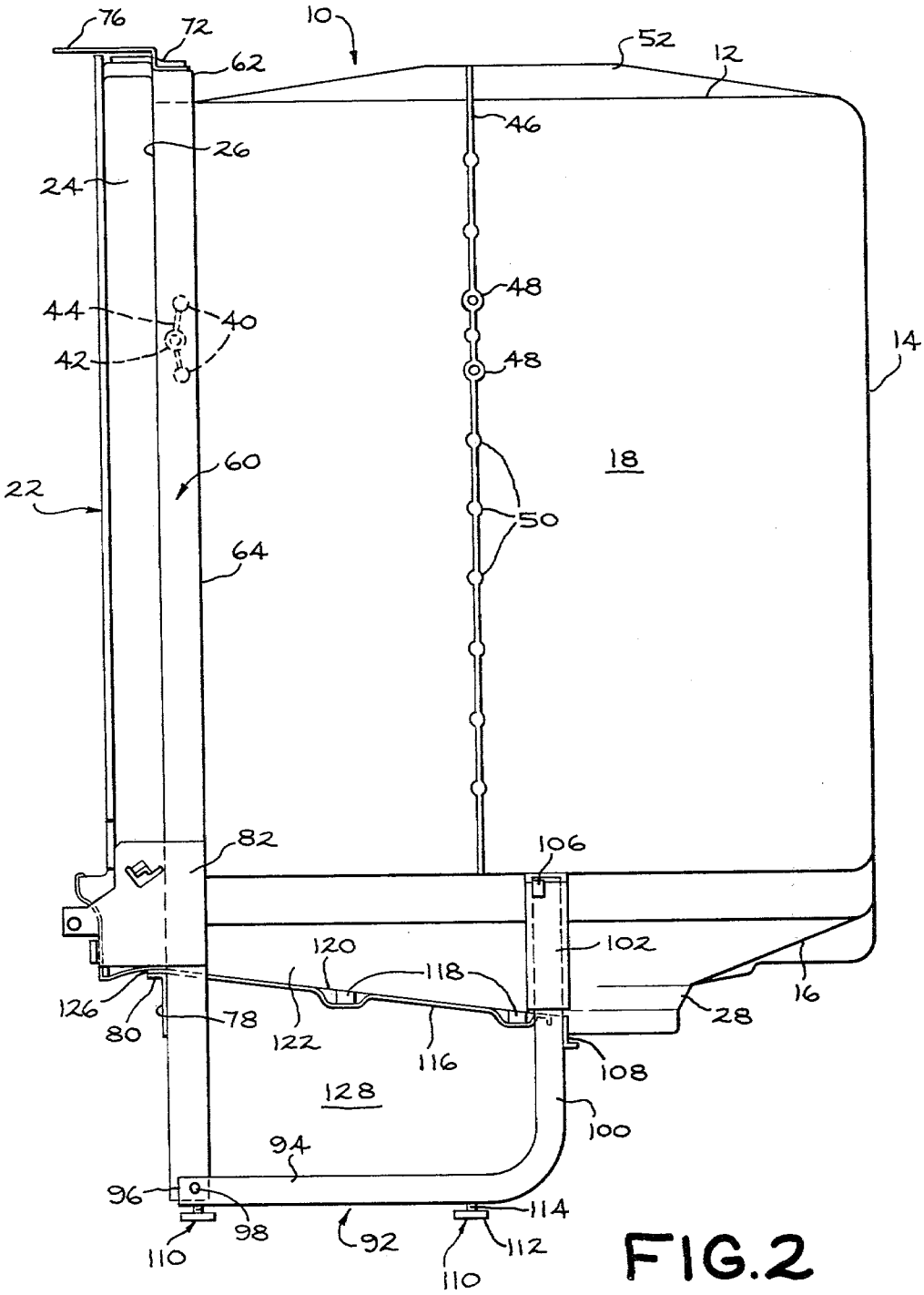
FIG. 2 is a side elevation view of the dishwasher tub assembly of FIG. 1.
Figure 3:
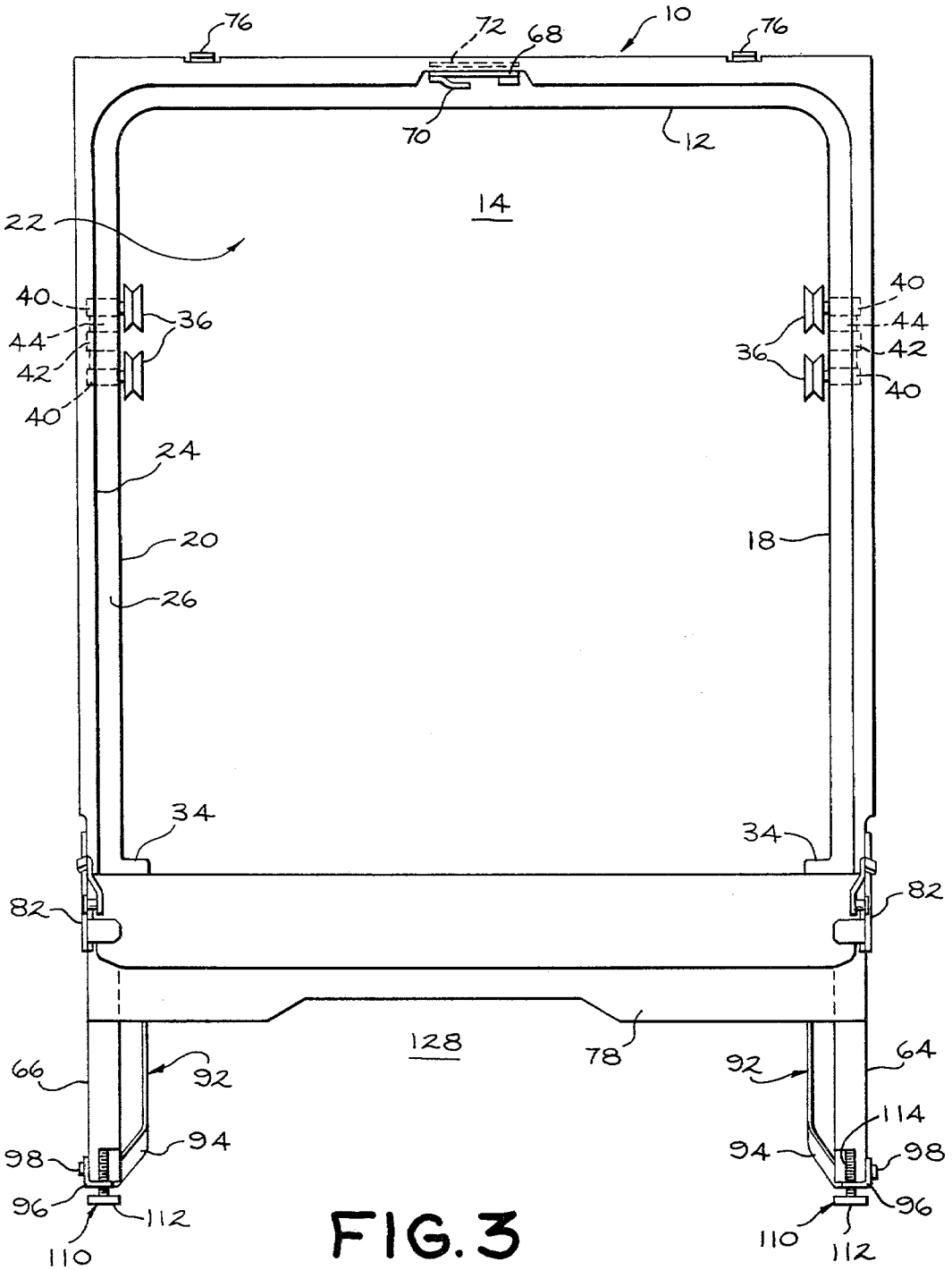
FIG. 3 is a front elevation view of the dishwasher tub assembly of FIG. 2.

FIGS. 1–3 illustrate a tub and frame assembly for a front loading dishwasher to be supported on a generally flat supporting surface such as a kitchen floor.

Tub 10 is of integrally molded plastic construction having a top wall 12, a rear wall 14, a bottom wall 16, side walls 18 and 20, and a generally rectangular front opening 22. A flared collar 24, molded around the sides and top of the front opening, forms an interior recessed shoulder 26 which provides a seat for the gasket around the dishwasher door (not shown) to provide a watertight seal when the door is closed and latched. Tub bottom 16 is contoured to provide a sump area 28 and to accommodate the pump and spray arm assembly (not shown) which includes a pump motor disposed beneath the tub bottom. The pump and spray arm assembly projects upwardly from the motor through tub opening 30 and the surrounding tiered collar-like structure 32.

A rack support shoulder 34 formed near the bottom of each of side walls 18 and 20 provides a track for rollers of a bottom dishwasher rack (not shown) to permit in and out movement of the dishwasher rack for loading and unloading. An upper dishwasher rack (not shown) is supported by a set of four rollers mounted to the interior of each side wall. Each set comprises a front pair of rollers 36 and a rear pair of rollers 38. Front pair 36 is secured to bosses 40, formed on the exterior surface of each side wall adjacent the front opening of the tub. A central support boss 42 is formed between bosses 40 to facilitate the securing of the tub to the main support frame in a manner to be described hereinafter. A reinforcing web 44 extends between the bosses to provide additional structural support for front rollers 36. A reinforcing rib 46 running essentially the length of each of side walls 18 and 20 provides structural reinforcement for rear rollers 38. Rear rollers 38 are suitably secured, such as by screws, to bosses 48 formed in rib 46. Additional fabrication bosses 50 formed with rib 46 are provided to prevent warping of the walls and sink marks pursuant to a method for molding ribbed structures disclosed in commonly-assigned, copending U.S. Patent Application, Ser. No. 203,014, filed Nov. 3, 1980 for "Method for Molding Ribbed Structures," by the present inventor. Top wall 12 of tub 10 is dimpled at 52 to accommodate a spray device (not shown) above the upper rack.

Primary structural support for plastic tub 10 is provided by main support frame 60 and rear support members 92. Main support frame 60 comprises a continuous bar or channel of U-shaped cross section formed into an inverted U-shaped configuration having a base portion 62 and legs 64 and 66 depending therefrom. The base and legs surround the tub on three sides adjacent the front opening, with the base supportingly engaging the top wall, and legs 64 and 66 supportingly engaging side walls 18 and 20, respectively. Legs 64 and 66 extend from the base portion downwardly beyond the tub bottom for mounting on the supporting surface, typically the floor. For purposes of this description, the phrase "mounting on the supporting surface" is intended to refer not only to contact of the legs or rear support members with the supporting surface directly but also contact through cushioning pads, or more typically levelling pads carried on the legs as rear support members, or through even rollers as may be used for convertible dishwashers.

Main support frame 60 is positioned about front opening 22 with the inwardly facing U-channel 61 riding over mounting means which in the illustrative embodiment comprises embossments 40 and 42 formed on and projecting outwardly from the exterior surface of each of tub side walls 18 and 20. The tub is secured to the main frame by fastening means such as screws 67 fastened to embossments 42 when the top wall abuts the base portion 62 of the main frame. Screws 67 are operative when tightened to draw side walls 18 and 20 toward legs 64 and 66, respectively, so as to cause the lateral dimensions or width of the front opening 22 of the tub to conform to that of support frame 60.

The top wall 12 is likewise secured by screws to the main frame in a manner hereinafter described. A recess 68 is formed along the top center portion of the collar 24 to accommodate the strike portion 70 of the door latch mechanism (not shown). A latch flange 72 for supporting latch strike 70 is secured by any suitable means, such as by spot welding, to base portion 62 of the main frame. Latch flange 72 extends from the main frame over recess 68. Latch strike 70 is positioned in recess 68. The portion of tub collar 24 adjacent recess 68 is sandwiched between the flange 72 and the latch strike 70. Strike 70 is attached to flange 72 by screws 74 passing through strike 70, tub collar 24 and flange 72, thereby securing both the strike 70 and the top wall 12 of tub 10 to the main frame 60. The major portion of the door latch mechanism (not shown) is carried on the dishwasher door (not shown). This main portion of the latch mechanism may be of conventional design and forms no part of the present invention and is thus omitted from the present description for the sake of clarity and brevity.

Structural reinforcement for main frame 60 is provided by a rigid front cross member 78 comprising a metal plate extending between legs 64 and 66, generally parallel to the supporting surface. Cross member 78 is suitably secured at its opposite ends to legs 64 and 66, respectively, such as by spot welding or other means effective to prevent relative movement between the legs and the cross member. A flange 80 is formed along the length of member 78 to increase the rigidity of the member and provide a flat surface which supportingly engages the bottom wall 16 of the tub. Thus, cross member 78 provides vertical support for the tub and enhances the lateral rigidity of the main support frame.

Frame 60 and cross member 78 operate to rigidify the top and side walls of tub 10 adjacent the open front to combat "parallelogramming" of the front opening due to side loads such as might result from the dishwasher resting on an uneven floor.

A pair of counter support flanges 76 are suitably secured to base 62 frame 60 on either side of latch flange 72 by a suitable means such as spot welding. Upon installation of the dishwasher under the kitchen counter in a home, support frame 60 is secured to the underside of the counter top by screws passing through flanges 76.

Hinge support flanges 82 are suitably secured to legs 64 and 66 just above cross member 78. Flanges 82 provides mounts for the door hinge assembly (not shown).

It is customary to provide means for counterbalancing the weight of the dishwasher door. As such means are not a part of the present invention, a description of such means is omitted for the sake of brevity and simplicity. However, a counterbalance arrangement which has been found to work satisfactorily with the frame structure of the present invention is described in detail in copending, commonly assigned U.S. Patent application Ser. No. 103,649, filed Dec. 14, 1979, by the present inventor, the disclosure of which is hereby incorporated by reference.

Structural support for the rearward portion of the tub 10 is provided by a pair of rigid rear support members 92. One end of each rear support member is attached to a corresponding one of said main support frame legs. The rear support member extends generally rearwardly from the main support frame for mounting on the supporting surface and then upwardly. The other end of each rear support member supports the rear portion of tub 10. The main support frame and the rear support members operate to space the tub above the supporting surface to provide a service space between the bottom wall of the tub and the supporting surface. This service space houses operating components (not shown) including the usual pump motor and solenoid control valves.

In the illustrative embodiment, each of rear support members 92 comprises a metal channel of U-shaped cross section joined at one end 96 to the corresponding one of legs 64 and 66. The ends 65 and 67 of main support frame legs 64 and 66, respectively, are received in the upwardly facing channel of the corresponding rear support member. Each rear support member and its corresponding front leg are secured together by suitable means such as by a rivet 98. Each rear support member 92 includes a runner portion 94 extending from its end 96 rearwardly parallel to the support surface for mounting on the support surface. The other end of each support member comprises a rear leg portion 100 extending generally upwardly from runner portion 94 to support the rear portion of the tub. To this end, the rear leg portions 100 are received in pockets 102, integrally formed for this purpose on the lower rear portion of tub 10 as shown in FIGS. 1 and 2. Tabs 106 formed on the ends of rear legs 100 project through apertures 104 formed in pockets 102 and are folded back over the pocket wall during assembly to retain the legs in the pockets.

A rigid rear crossing member is fixedly attached at each end to a respective one of the rear legs and extends between the legs in abutting engagement with the tub bottom to provide vertical support to the rear of the tub. In the illustrative embodiment, the rear crossing member comprises a metal member 108 of generally right angular cross section, spot welded at each end to one of rear legs 100.

While runner portions 94 could be mounted directly on the supporting surface, levelling feet 110 are provided in the illustrative embodiment to enable the installer of the appliance to compensate for an uneven supporting surface by adjustment of the height of the levelling feet. Levelling feet 110, comprising a generally flat pad 112 and a threaded stem 114, extend downwardly from runners 94. The threaded stem is received in complimentarily threaded aperture in the runner.

During washing and rinsing operation, hot water accumulating in the tub bottom may cause the tub bottom to tend to stretch and vertically deflect or sag. A rigid metallic bottom liner 116 fixedly attached to the tub bottom extends beneath and supportingly engages at least a portion of the bottom wall 16 to limit vertical deflection of the tub bottom and to support the pump motor and spray arm assembly (not shown).

Tub bottom wall 16 includes two planar sections 122, one of which tapers inwardly from side wall 18 and the other from side wall 20. A third planar section 124 slopes gently rearwardly from the front opening to form the major portion of the bottom wall. Section 124 intersects sections 122 along intersections 120. The intersection of these planar surfaces provides additional structural rigidity to the tub bottom wall in the region of the intersection. Bosses 118 formed along intersection 120 project downwardly from the tub bottom to provide mounting points for bottom liner 116. These mounting points are relatively stable because the enhanced rigidity of the region around intersections 120 tends to resist vertical deflections. Bottom liner 116 is secured by any suitable means to bosses 118, with forward edge 126 of liner 116 sandwiched between flange 80 of front cross member 78 and bottom wall 16 of tub 10. Because of the rigidity of the bottom liner 116 and the relatively stable mounting points provided by bosses 118, bottom liner 116 is able to limit vertical deflections of the tub bottom and to maintain the vertical position of the pump and spray arm assembly, so as to assure proper clearance for the spray arm between the bottom dishrack (not shown) and the bottom tub wall.

Bottom liner 116 serves additionally as a flame barrier separating the electrical motor, solenoids, and any other electrically energized components supported beneath the tub in service space 128 (FIG. 2) from the plastic tub.

It should be apparent from the foregoing description that the present invention provides a plastic tub and steel frame assembly which employs significantly less steel than prior art designs, while retaining substantial structural advantages of a steel frame. Additionally, the assembly of the present invention is easily assembled and thus readily adaptable to automated assembly.

The background discussion of this specification is related primarily to front-loading dishwashers of the type normally adapted for a permanent undercounter installation as opposed to the type of dishwasher having a hinged top closure for top-loading. However, it should be emphasized that many such front-loading machines are commercially produced and purchased for indefinite use as a freestanding "convertible" model adaptable at a later time by the owner to a built-in unit beneath a kitchen countertop. It should be understood that the present invention is specifically directed to the front-loading type of dishwasher structure whether of the built-in or convertible type.

While a specific embodiment of the present invention has been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A tub assembly for a front loading washing appliance to be supported on a generally flat supporting surface, said tub assembly comprising:

a plastic tub comprising a top wall, a back wall, a bottom wall, and two side walls having an open front; an integral support boss extending outwardly from each side wall adjacent the front opening;

a main support frame formed from a narrow, continuous metal member of U-shaped cross-section; said frame formed into an inverted "U" configuration having a base and a pair of depending legs; said main frame positioned about said plastic tub with said base supportingly engaging said tub top wall and each of said depending less supportingly engaging a corresponding tub side wall; said legs extending downwardly beyond said tub bottom for mounting on said supporting surface;

each of said support bosses being received within a corresponding depending leg, fastening means securely interconnecting each corresponding boss and leg to cause the lateral dimension of the front opening to conform to that of said main frame;

a rigid front crossing member fixedly attached to each of said depending legs and extending therebetween beneath said tub and generally parallel to the supporting surface and supportingly engaging said tub bottom wall;

a pair of rigid rear support members, each formed from a narrow continuous metal member of U-shaped cross-section; each rear support member having one end fixedly attached to the lower portion of a corresponding main frame leg, a first section extending rearwardly from said corresponding main frame leg for mounting on the supporting surface and a second section extending upwardly and supporting the rear portion of said tub;

said main frame and said rear support members spacing the bottom wall of said tub above the supporting surface to provide a service space for receiving various operating components.

2. A tub assembly in accordance with claim 1 wherein a pair of rack attachment bosses extend outwardly of each tub side wall integrally with a corresponding support boss, one rack attachment boss positioned above and one rack attachment boss positioned below said corresponding support boss and received within said corresponding depending leg.

3. A tub assembly in accordance with claim 1 further comprising a rigid bottom liner fixedly attached to said bottom wall and extending beneath and in supporting engagement with said bottom wall and operative to limit vertical deflections of said bottom wall.

4. A tub assembly in accordance with claim 1 wherein said rear portion of said tub has formed therewith a pair of downwardly opening pockets for receiving said second sections of said rear support legs.

5. A tub assembly in accordance with claim 4 further comprising a rigid rear crossing member fixedly attached to each of said second sections of said rear support members and extending therebetween beneath said bottom wall and generally parallel to the supporting surface and supportingly engaging said bottom wall.

* * * * *

UNITED STATES PATENT AND TRADEMARK OFFICE

CERTIFICATE OF CORRECTION

PATENT NO. : 4,359,250

DATED : November 16, 1982

INVENTOR(S) : Thomas E. Jenkins

It is certified that error appears in the above—identified patent and that said Letters Patent is hereby corrected as shown below:

Column 8, line 2, delete "legs" and insert -- members --.

Signed and Sealed this

*Eighth* Day of *February 1983*

[SEAL]

*Attest:*

GERALD J. MOSSINGHOFF

*Attesting Officer*

*Commissioner of Patents and Trademarks*